US006478561B2

(12) United States Patent
Braun et al.

(10) Patent No.: US 6,478,561 B2
(45) Date of Patent: Nov. 12, 2002

(54) KIT OF PARTS FOR FILLING CRACKS WITH FOAMABLE POLYURETHANE PREPOLYMER

(75) Inventors: Robert Braun, New Lenox, IL (US); Diana Dobrez-Florez, Crest Hill, IL (US); Jess Garcia, Warrenville, IL (US); Deborah Schutter, Minooka, IL (US)

(73) Assignee: Flexible Products Company, Marietta, GA (US)

( * ) Notice: Subject to any disclaimer, the term of this patent is extended or adjusted under 35 U.S.C. 154(b) by 0 days.

(21) Appl. No.: 09/933,303

(22) Filed: Aug. 20, 2001

(65) Prior Publication Data

US 2001/0054474 A1 Dec. 27, 2001

Related U.S. Application Data

(62) Division of application No. 09/248,670, filed on Feb. 11, 1999, now Pat. No. 6,309,493.

(51) Int. Cl.[7] ..... B32B 35/00

(52) U.S. Cl. ..... 425/12; 425/13; 425/87; 222/567; 206/321

(58) Field of Search ..... 425/11, 12, 13, 425/87; 222/74, 566, 567; 206/321

(56) References Cited

U.S. PATENT DOCUMENTS

| | | | | | |
|---|---|---|---|---|---|
| 3,236,005 | A | * | 2/1966 | Tomosy et al. | 46/90 |
| 4,360,994 | A | * | 11/1982 | Hodges | 52/744 |
| 4,681,986 | A | * | 7/1987 | Settineri | 174/84 R |
| 4,758,295 | A | * | 7/1988 | Sawaide et al. | 156/98 |
| 4,884,300 | A | * | 12/1989 | Vistins | 2/162 |
| 5,549,228 | A | * | 8/1996 | Brown | 222/570 |
| 5,615,804 | A | * | 4/1997 | Brown | 222/136 |
| 5,732,530 | A | * | 3/1998 | Pfaff | 53/403 |

OTHER PUBLICATIONS

Lily Corporation Bill of Wares, Mar. 1997, pp. 1–45.*

* cited by examiner

*Primary Examiner*—Jan H. Silbaugh
*Assistant Examiner*—Joseph S Del Sole
(74) *Attorney, Agent, or Firm*—Vedder Price Kaufman & Kammholz

(57) ABSTRACT

A kit of parts useful for sealing a crack in a concrete surface by injecting a sealing material into the crack including a plurality of injection port members and deformable metal crimping sleeves. Each injection port member has a flat base which is attached to the concrete surface by a settable adhesive compound. A disposable, aerosol-charged, supply container having a one-component polyurethane prepolymer without any granular material entrained therein.

4 Claims, 5 Drawing Sheets

KIT OF PARTS FOR FILLING CRACKS WITH FOAMABLE POLYURETHANE PREPOLYMER

This application is a divisional of application Ser. No. 09/248,670, filed on Feb. 11, 1999, now U.S. Pat. No. 6,309,493.

BACKGROUND OF THE INVENTION

The present invention relates generally to systems for filling cracks in foundation walls, and more particularly, to a method of filling such cracks with an aerosol liquid and to a system for use with such a method.

Many methods of construction are not perfect. Homeowners that purchase newly built or older homes may discover cracks in the foundation walls of their homes. These cracks may be large in size, up to one-half inch in width or they may be small in size, up to three-sixteenths inch in width. Cracks in any foundation walls, no matter what the size of the crack, can unfortunately leak and admit water into the basement of the house, possibly damaging furnishings and finished areas of the basement.

There are many compounds available in the marketplace for sealing such foundation cracks. Some of these compounds include two-component reactive epoxies, hydraulic cements or grouts and plastic-based fillers that are troweled into the crack.

It is also generally known to use polyurethane-based foams to seal such cracks. U.S. Pat. No. 3,847,722 that issued Nov. 12, 1974 describes a crack sealing apparatus and method utilizing a deformable and permeable substrate that is impregnated with a hydrophilic urethane prepolymer for filling cracks and preventing water from leaking through the crack. This substrate includes a complex web element that is formed from an expanded vermiculite. The web element must be impregnated with a separately provided urethane prepolymer by the user, by pouring it onto the web to saturate it entirely with the prepolymer. Once the web element is saturated, the web element is folded or rolled up and wedged or pushed into the crack. When the impregnated material contacts water passing through the crack, the prepolymer expands to form a water-insoluble polyurethane gel. The use of this urethane prepolymer in liquid form by the user is not only messy, but also the user must store the prepolymer in a moisture-proof container to avoid exposure to moisture and start the activation and curing of the prepolymer.

Another similarly complicated method of fixing cracks is described in U.S. Pat. No. 4,758,295, issued Jul. 19, 1988. This patent describes a method of sealing leaks in cracks of concrete walls using a moisture-cured polyurethane prepolymer that has a separate impregnating agent added to it in the form of a granular agent, such as cement or grout. Adding such an agent to a prepolymer is expensive. It may also likely affect the dispensing and injection characteristics of the prepolymer leading to application difficulties and necessitating the use of a high-pressure injection system that is beyond the expense and ability of an ordinary consumer and homeowner.

Neither of these two patents provide a user-friendly system for filling cracks that is simple to use by a homeowner and disposable. Accordingly, the present invention is directed to a method for filling cracks with a liquid hydrophilic urethane prepolymer utilizing a prepressurized aerosol delivery of the prepolymer into the crack and a kit of parts for utilizing such a method that is easily utilized by a consumer to fill cracks without any technical expertise.

SUMMARY OF THE INVENTION

It is therefore a general object of the present invention to provide a concrete crack filling system for use by consumers that is user-friendly and disposable.

It is another object of the present invention to an improved method for filling cracks in concrete by injecting a urethane prepolymer into a crack from a pressurized supply container utilizing an injection tube that enters the mouth of the crack, the injection tube and supply container being disposable.

It is a further object of the present invention to provide a method for filling cracks in concrete or stone walls that includes the steps of: cleaning out loose debris from the crack; applying one or more injection ports to the concrete or stone wall to provide one or more entryways into the crack; covering the exterior of the crack with a sealant material to enclose the crack and the injection ports; providing an amount of crack filling compound in the form of a moisture curable, one-component polyurethane prepolymer in a disposable, aerosol-pressurized container; providing a disposable dispensing nozzle for the aerosol container; injecting the prepolymer into the crack by way of the injection ports and letting the prepolymer cure and seal the crack.

Another object of the present invention is to provide a kit of parts for sealing cracks, the kit including a disposable pressurized container of one-component urethane prepolymer, a dispensing nozzle and injection tube that are attachable to the supply container, a plurality of injection ports and an epoxy compound for sealing the injection parts to the crack.

Yet still another object of the present invention is to provide a method for reliably filling cracks in a concrete or stone wall that includes the steps of: cleaning the crack to remove base debris; attaching a plurality of injection ports over the crack and in communication with the crack, the injection ports being spaced a predetermined distance apart from each other; sealing the outer surface of the crack to create a continuous internal cavity within the crack; testing the sealed crack for continuity; providing a disposable pressurized container containing a one-component urethane prepolymer that expands upon exit from the container and contact with water; methodically injecting, in a stepwise fashion, the prepolymer into the crack from the bottom up through one injection port at a time, permitting the injected prepolymer to flow into the crack to the level of the next injection port, capping off the lower injection port and injecting the prepolymer at the next injection port above the capped injection port.

These and other objects, features and advantages of the present invention will be clearly understood through consideration of the following detailed description.

DETAILED DESCRIPTION OF THE PREFERRED EMBODIMENT

Figure 1:
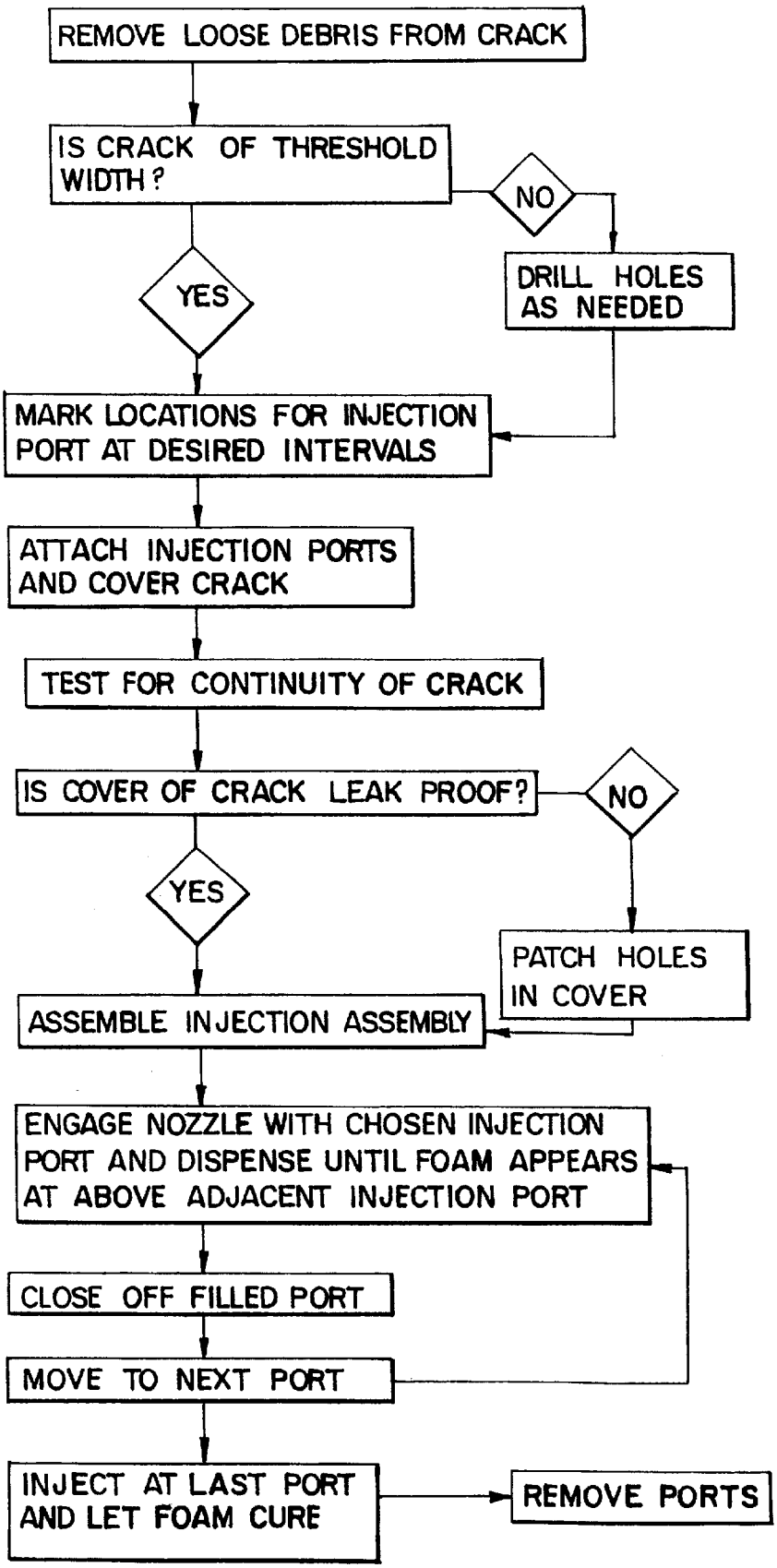
FIG. 1 is a process flow chart, illustrating schematically, the steps employed in the methods of the present invention.
Figure 2:
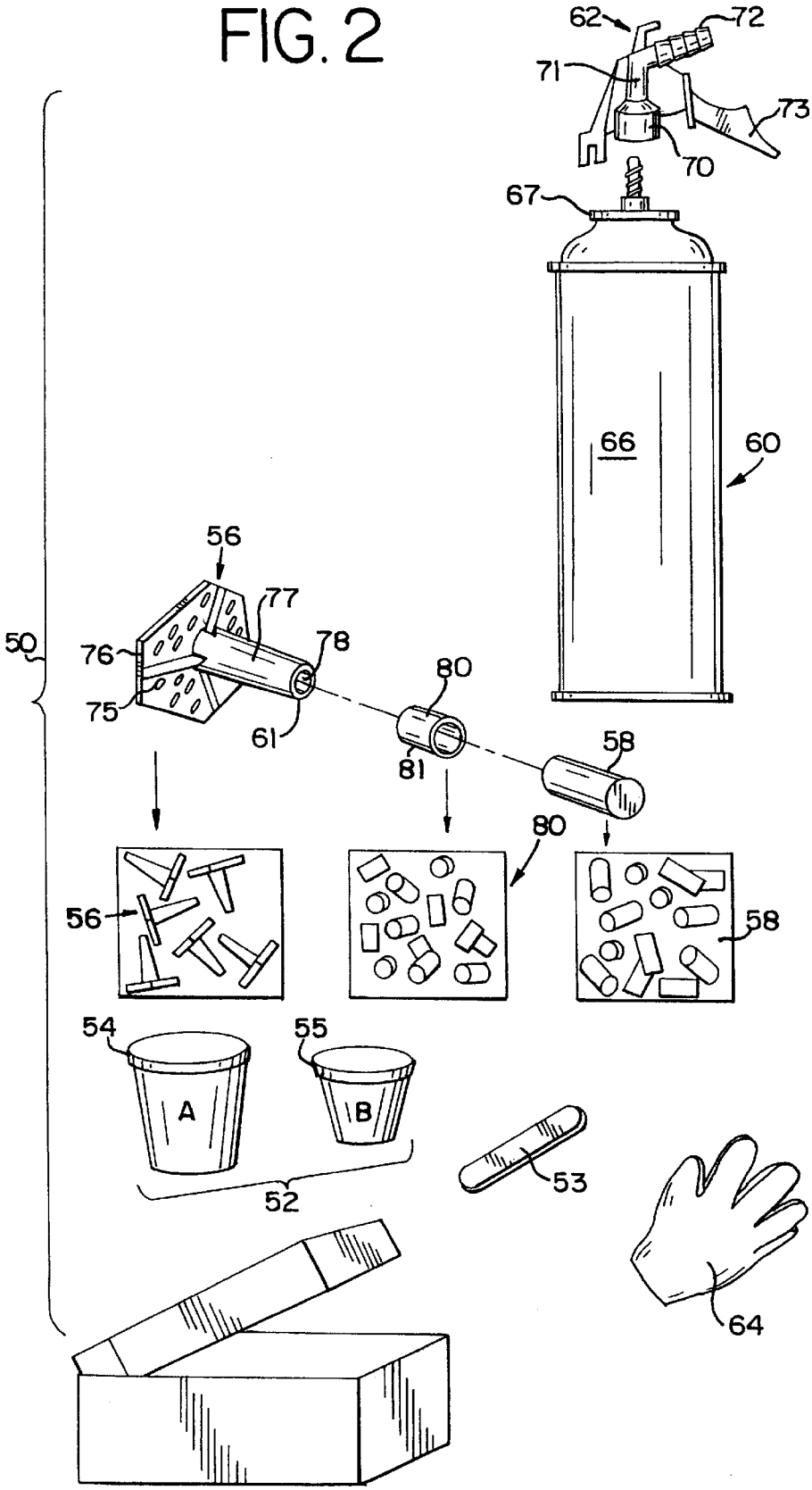
FIG. 2 is perspective view of a kit of parts used in the methods of the present invention.

The present invention is directed to a method of filling cracks in solid, poured concrete and/or stone walls using a kit of parts 50 that are easily utilized by a homeowner. Such a kit 50 is illustrated in FIG. 2. The kit 50 preferably contains a settable adhesive exterior covering compound 52, shown as a two-part epoxy compound utilizing respective, separate amounts of A and B reactive components 54, 55 with a spatula 53 for mixing the components together, a plurality of crack injection ports 56, a plurality of caps 58 that fit over the ends of the injection ports 56, a series of crimps 80 that fit on the injection ports 56, a pressurized container 60 with a supply of an aerosol-driven, one-component prepolymer, and a dispenser assembly 62 that fits the supply container 60 and that mates with the injection ports 56. A set of disposable gloves 64 may also be provided for the user in the kit 50.

Figure 9:
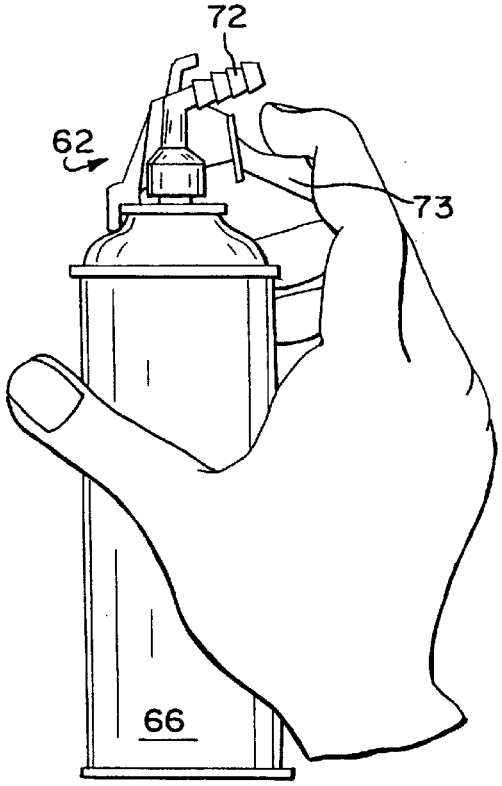
FIG. 9 is a view illustrating the step of assembling the foam injection assembly.

The supply container 60 preferably takes the form of disposable aerosol can 66 as shown in FIG. having a valve assembly 67 formed in one end 68 thereof by which the crack-filling compound exits from the container 60 when the valve assembly 67 is actuated. The dispenser assembly 62 illustrated can be seen to have a hollow base portion 70 that engages the valve assembly 67 of the aerosol can 66 and a body portion 71 that is interposed between the base portion 70 and an elongated nozzle 72. An actuator lever 73 is joined to the body portion 71 and extends out from the central axis of the supply container 60 at an angle therefrom so that a user may contact it with one or more fingers while holding the container 60. (FIG. 9.)

Figure 2A:
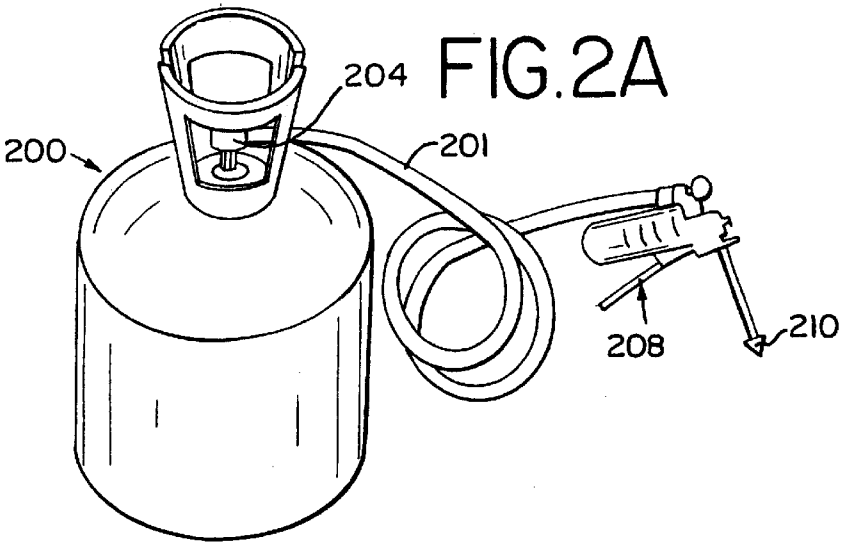
FIG. 2A illustrates some alternate components that suitable for use in the kit of parts of FIG. 2.

Alternatively, as illustrated in FIG. 2A, the disposable container may take the form of a larger container 200, commonly referred to in the art as a "180" container that is filled with approximately 30 pounds of sealing material. This container is also known by its DOT designation as a DOT-39 RC 260/325 container. This container is disposable in the sense that it is manufactured as a thin-walled container that cannot be refilled under federal law. The container 200 has associated therewith, a delivery hose 201, a valve assembly 204 and a hand-operated dispensing gun 208 through which the contents of the container may be discharged. The gun 208 preferably has a tip that mates with the body portions 77 of the injection ports 56. Such a gun is commonly sold by the assignee of the present invention under the trade names "Pro-Gun" or "Great-Gun" and are used to dispense one-component polyurethane prepolymers. The structure of such guns are described in U.S. Pat. Nos. 5,615,804 and 5,549,228, the disclosures of which are herein incorporated by reference.

As further shown in FIG. 2, the kit 50 includes a plurality of injection ports 56 that have flat, perforated base portions 76 for attachment to the surfaces surrounding the crack 90. The perforations 75 in the base portions 76 of the ports 56 permit the adhesive 52 to securely mount them to and over the crack 90. The injection ports 56 further include a tubular, hollow body portion 77 that is open at both ends thereof. This body portion 77 defines a hollow injection passage 78 through the ports 56 into the crack.

Figure 11:
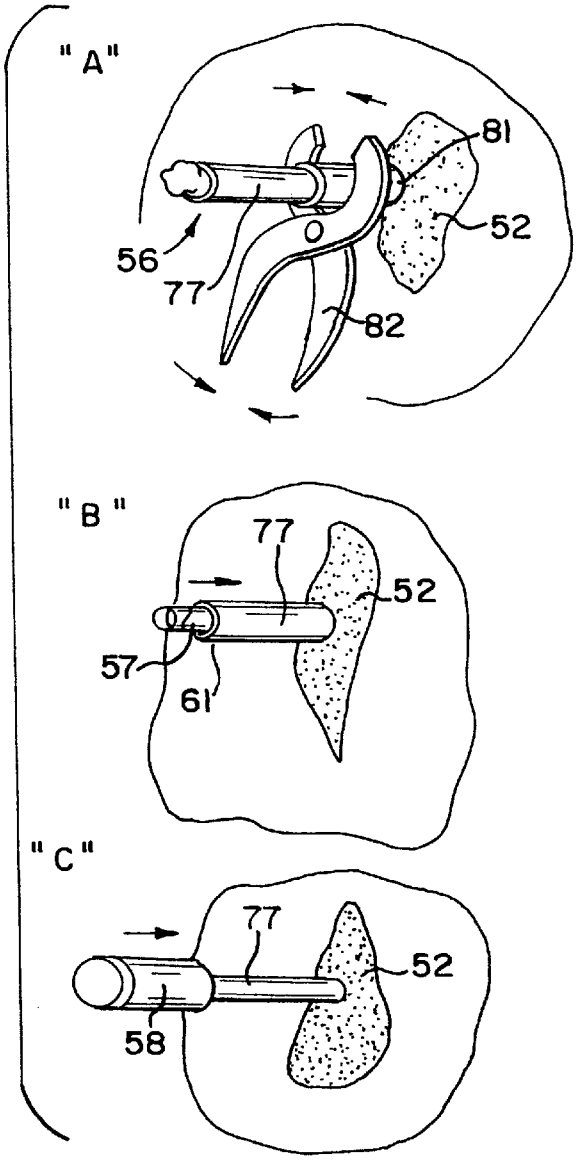
FIG. 11 is a view illustrating the step of closing off the injection port with different closure elements to prevent backflow of the crack-filling prepolymer out of the port.

A series of closure elements, such as crimps 80 may be supplied with the kit 50 that may be applied to the body portions 77 of the injection ports 56 in order to constrict the size of the passage in the injection port body portion 77 or to close off the passage altogether. These crimps 80 preferably take the form of hollow metal collars 81 that are sized to fit onto and over the injection port body portions 77. When squeezed by a pliers 82 or other tool as shown in detail "A" of FIG. 11, the crimps 80 deform and serve to pinch the injection port body portions 77 closed or to at least partially collapse them to prevent the flow of prepolymer back out of the injection port 56. The kit 50 may further include a set of caps 58 (shown in detail "C" of FIG. 11), in place of the crimps 80, that fit over the free ends of the injection ports 56 for sealing the free ends 61 of the ports 56. As shown in detail "B" of FIG. 11, plugs 59 that are insertable into the open ends 61 of the injection ports may also accompany the kit in lieu of the crimps 80 or caps 58.

As stated previously, the kit 50 includes a hand-held, pressurized supply container 60 that contains a predetermined amount of an injectable crack filling compound. This compound is preferably a one-component polyurethane prepolymer that is moisture-cured, i.e., hydrophilic in nature, and which is easily dispensed under aerosol pressure and which expands and foams when dispensed from its supply container 60 and when it contacts moisture. The composition of this compound includes a polyester polyol, an isocyanate, a catalyst such as a B–B'dimorpholinodiethylether and a plasticizer such as a mixture of dibutyrate ester isomer. When the isocyanate is reacted with the aforementioned polyol, a polyurethane liquid with an affinity for water is created. The crack filling compound has an excess amount of isocyanate to make it hydrophilic. A propellant is provided in the supply container 60 that drives the compound out of the container 60 and assists in partly forming the foamed end product. A charge of nitrogen having a pressure of about 125 psi is used as the propellant in order to drive the prepolymer out of the supply container and into the crack as explained in greater detail below.

Importantly, unlike the aforementioned prior art, the crack filling compound does not include a granular material as a crack impregnating agent, such as a water-reactive cement or grout. With the use of such a material, as taught by U.S. Pat. No. 4,758,295, care must be taken by the applicator to ensure the proper ratio of materials so as not to affect the curing characteristics thereof. Additionally, because the present invention does not utilize any additional granular component or additive such as cement or grout, the crack filling prepolymer of the present invention is more inexpensively made and may be easily dispersed from an aerosol container, such as the hand-sized can 66 depicted.

Figure 3:
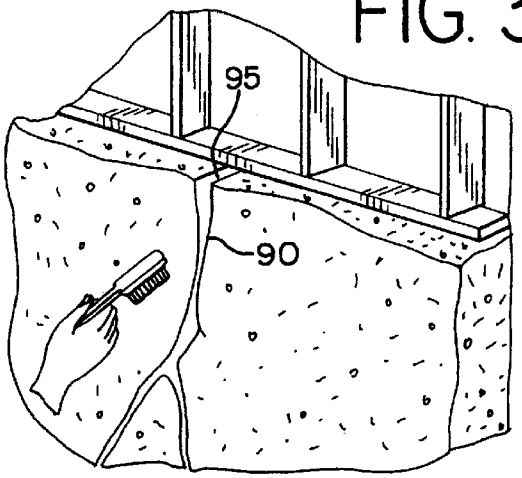
FIG. 3 is a view illustrating the step of cleaning out a crack in a concrete or stone wall.
Figure 5:
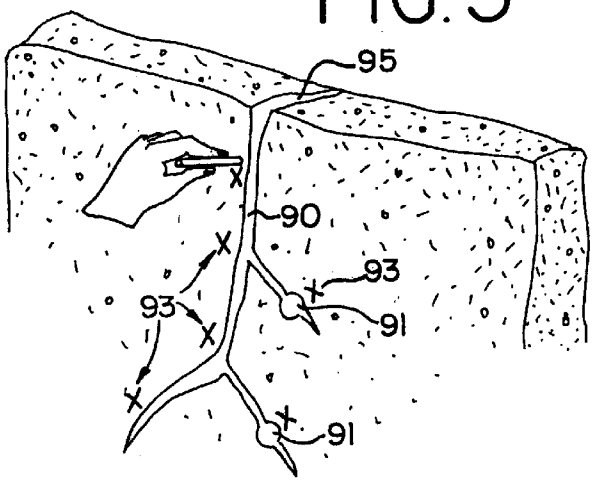
FIG. 5 is a view illustrating the step of marking injection port locations at a desired spacing along the crack.
Figure 4:
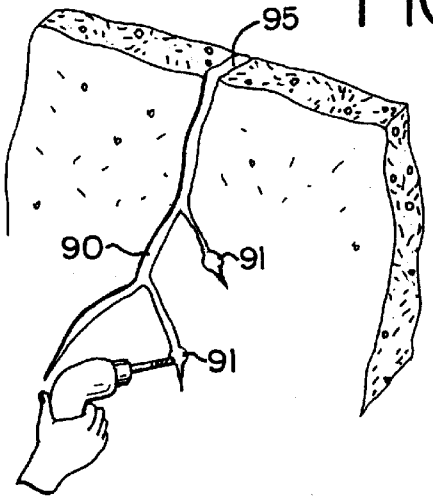
FIG. 4 is a view illustrating the step of drilling an injection opening in the crack.

The implementation the methods of the present invention shall now be discussed. The preliminary step in this inventive method is illustrated in FIG. 3 and involves cleaning of the crack 90 by using a brush or compressed air or other similar means in order to remove loose debris, dirt and from the crack 90. The size of the crack 90 is first determined, and if the crack is less than one-quarter to one-eighth inch in width, injection holes 91 are drilled into the surface 92 and crack 90 at intervals of about 8 to 10 inches beginning at the base of the crack 90 and ending beneath the top of the crack, preferably about 5 to 6 inches below the top. (FIG. 4.) Where the width of the crack 90 is greater than one-eighth to one-fourth inches, injection port registration marks 93 are placed at intervals of about 10 to 12 inches. (FIG. 5.)

Figure 6:
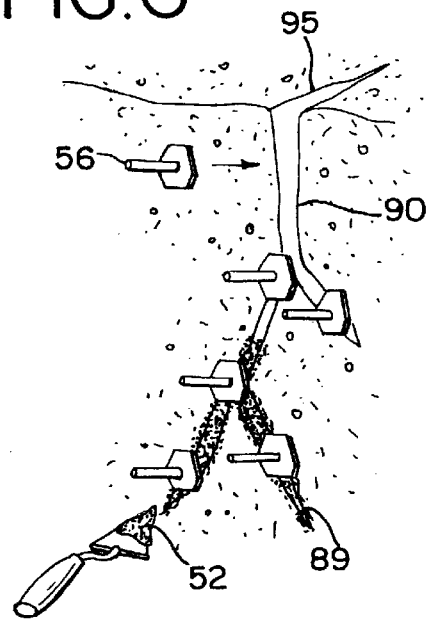
FIG. 6 is a view illustrating the step of attaching the injection ports to the crack and sealing the crack around the injection ports to provide an exterior cover for the crack.

A series of injection ports 56 are then applied to the crack 90 at the marked intervals and in alignment with the injection holes 91. These ports 56 are applied to the crack by first mixing the adhesive components 54, 55 supplied in the kit 50 and applying it to the edges of the crack 90. The injection ports 56 have the mixed epoxy 52 applied to them using the spatula 52, or a trowel, so that the port base portions 76 are firmly embedded in it and excess epoxy flows through the perforations 75 in the port base portions 76. (FIG. 6). Once all of the injection ports 56 are attached, the remaining epoxy 52 is used to form a cover 89 extending over the crack 90 in order to completely cover the crack 90 and the base 76 of each port 56.

Once the epoxy has cured, typically about 24 hours, the crack 90 is tested for continuity by injecting a bubble-forming compound, such as a soapy water solution 92, into each of the ports 56. Air is applied to the bottom port of the crack 90 and the other ports are examined to determine the formation of bubbles 91 at the other ports 56. If bubbles form at the other ports, it indicates that there is continuity between all of the ports through the length of the crack 90.

Figure 7:
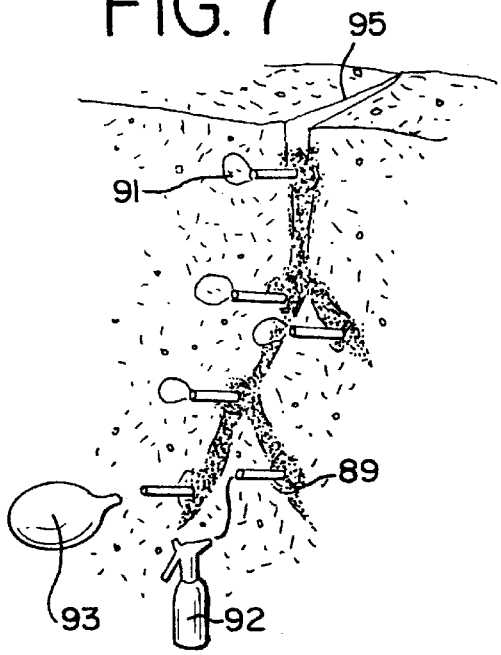
FIG. 7 is a view illustrating the step of testing the injection ports and the covered crack for continuity.
Figure 8:
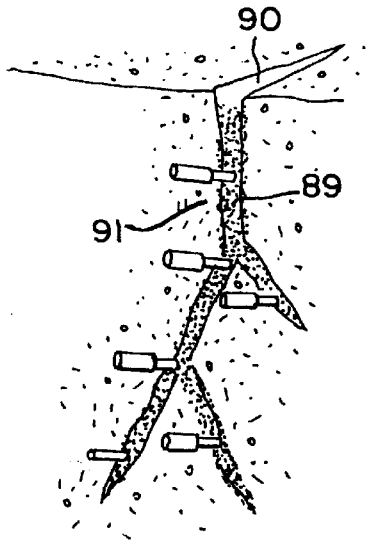
FIG. 8 is a view illustrating the step of testing the sealed crack for leaks.

The crack 90 and its epoxy cover 89 is then tested for leaks by placing caps 50 over all of the injection ports 56 except one, preferably the bottom port. Soapy water 92 is again preferably sprayed into the open injection port and then air is injected into the open port 56 via a suitable means, such as the squeeze bottle 94 illustrated in FIG. 7. The epoxy cover 89 is then examined for bubbles 91 that would indicate leaks in it. Any such leaks that are found may then be sealed with a fast-set epoxy.

Figure 10:
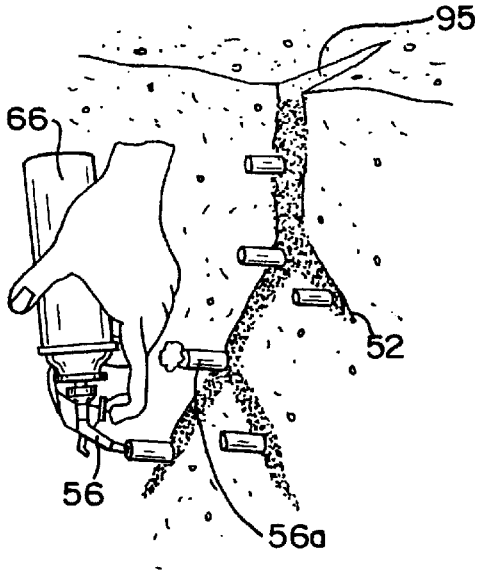
FIG. 10 is a view illustrating the step of injecting the crack-filling prepolymer into the crack in a stepwise fashion.

The foam dispenser is then assembled by engaging the dispenser assembly 62 to the valve assembly 67 of the supply container 60. (FIG. 9.) The dispenser nozzle 72 is then mated to the bottom injection port 56 after inverting the can 60 by inserting the tip thereof in to the injection port body portion 77 and the dispenser actuator lever 72 is depressed by the user in order to open the valve assembly 67. (FIG. 10.) The prepolymer then exits the container 60 and flows through the bottom port 56 into the crack 90 up to the next injection port 56*a* located above it. A crimp 80 (FIG. 11, detail "A") is then crimped to the port body portion 77 in order to seal the lower port. Alternatively, the dispenser is then removed and a cap 58 or plug 57 (details "B" and "C" of FIG. 11), may then be applied to the end of the port. The dispenser is then moved to the next highest port and the process repeated until foam is injected into the topmost injection port and appears at the top 95 of the crack.

The polyurethane prepolymer is injected from the bottom up along the crack 90 because it is desirable to have the foaming material push itself up through the crack in order to avoid the formation of air pockets. As the prepolymer meets and reacts with water in the crack 90, it forces air in the crack upward and out of the crack at the top 95 of the concrete wall.

Figure 13:
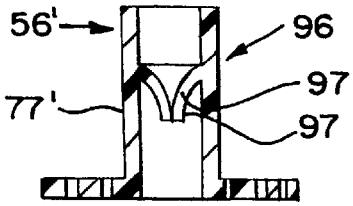
FIG. 13 is a cross-sectional view of an alternative injection port that may be used with the present invention.

Alternatively, as shown in FIG. 13, injection ports 56' having check or one-way valves 96 incorporated therein may be used to provide a connecting passage between the dispenser and the crack. The valve 96 of the port 56' will eliminate the need for the applicator to apply either a crimp 80 or a plug 58 to the port 56'. Such a valve 96 may include a diaphragm, or skirt member 97 that is located within the injection port body portion 77'.

Figure 12:
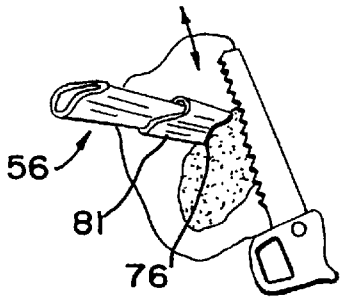
FIG. 12 is a view illustrating the step of removing the injection ports once the crack-filling compound has cured.

After the injection process is completed, the prepolymer is allowed to cure which will take about 7 to 10 days. It should be noted that the injecting of soapy water into the crack is beneficial in that it provides moisture that promotes the foaming of the prepolymer into an expandable foam. Standing water in the crack will also serve the same purpose. The water injection may also be easily accomplished via a conventional squeeze bottle 94. If, however, for any reason, no water is injected into the crack prior to injecting the prepolymer, the prepolymer will draw moisture out of the concrete and from the atmosphere for curing. Once the polyurethane foam has cured, the injection ports 56 may then be sawn off near their base portions 76. (FIG. 12.)

It will be appreciated that the present invention has a novel disposable nature in that all of its components may be discarded by the user after use. The prepolymer has no impregnating agent and comes in a pressurized supply container that is ready to use by a homeowner without the need for mixing or utilizing a separate dispensing system. The dispensing nozzle easily mates with the injection ports which also simplifies the implementation of the method so that a homeowner of average skill may use it to effectively seal cracks. Additionally, the polyurethane prepolymer is adhesive in nature so that it will adhere to the opposing surface of the crack and remain in place within the crack. It has a desirable viscosity that facilitates its injection into the crack, and it has a desirable flexibility that permits the cured foam to slightly expand and contract within the crack under various climatic conditions.

While the preferred embodiments of the invention have been shown and described, it will be apparent to those skilled in the art that changes and modifications may be made therein without departing from the spirit of the invention, the scope of which is defined by the appended claims.

What is claimed is:

1. A kit of parts for use in sealing a crack in a concrete surface by injecting a sealing material into said crack, the kit of parts comprising;

a plurality of injection port members, each of the injection port members having a flat base portion for attachment to said concrete surface, the base portion having a width sufficient to span said crack, and a hollow tubular portion that extends out from said base portion and defines a passage therethrough extending between a free end thereof and said base portion;

a plurality of deformable metal sleeve crimping collars which connect to the hollow tubular portion of each injection port member for sealing off said injection port member free ends;

a settable adhesive compound for attaching said injection port members to said concrete surface;

a disposable, aerosol-charged, supply container having a predetermined amount therein of a hydrophilic, one-component polyurethane prepolymer that reacts with moisture to foam and expand, the prepolymer not having any granular material entrained therein such that said prepolymer may be easily dispensed from said supply container by way of its aerosol charge;

said supply container having a valve assembly disposed at one end thereof; and, a dispensing assembly that is matable with said supply container valve assembly, the dispensing assembly including a dispensing nozzle extending out from said dispensing assembly at an angle, an actuating lever also extending at an angle from said dispensing assembly and said supply container so that said supply container may be held with one hand by a user and said actuating level may be depressed by the user with said one hand to dispense said prepolymer from said supply container into said injection port members.

2. The kit of parts of claim 1, wherein said dispensing nozzle has a tip that is sized to be received within said injection port member free ends.

3. The kit of parts of claim 1, further including a pair of disposable plastic gloves.

4. A kit of parts for use in sealing a crack in a concrete surface by injecting a sealing material into said crack, the kit of parts comprising:

a plurality of injection port members, each of the injection port members having a flat base portion for attachment to said concrete surface, the base portion having a width sufficient to span said crack, and a hollow tubular portion that extends out from said base portion and defines a passage therethrough extending between a free end thereof and said base portion;

a plurality of deformable metal sleeve crimping collars which connect to the hollow tubular portion of each injection port member for sealing off said injection port member free ends;

a settable adhesive compound for attaching said injection port members to said concrete surface;

a disposable, aerosol-charged, supply container having a predetermined amount therein of a hydrophilic, one-component polyurethane prepolymer that reacts with moisture to foam and expand, the prepolymer not having any granular material entrained therein such that said prepolymer may be easily dispensed from said supply container. by way of its aerosol charge;

said supply container having a valve assembly disposed thereon; and, a dispensing assembly for dispensing said prepolymer from said supply container, a delivery hose having one end matable with said supply container valve assembly, the dispensing assembly including a dispensing gun having a port for receiving another end of said delivery hose, and said dispensing gun having a trigger for actuating said dispensing gun to dispense said prepolymer therethrough from said supply container and into said injection port members, said dispensing gun having a dispensing tip that mates with said injection port members.

* * * * *